US008127686B2

(12) United States Patent
Lloyd

(10) Patent No.: US 8,127,686 B2
(45) Date of Patent: Mar. 6, 2012

(54) KINETIC ENERGY ROD WARHEAD WITH AIMING MECHANISM

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 577 days.

(21) Appl. No.: 11/185,555

(22) Filed: Jul. 20, 2005

(65) Prior Publication Data

US 2007/0084376 A1 Apr. 19, 2007

Related U.S. Application Data

(63) Continuation-in-part of application No. 11/059,891, filed on Feb. 17, 2005, now Pat. No. 7,621,222, and a continuation-in-part of application No. 11/060,179, filed on Feb. 17, 2005, now Pat. No. 7,624,682, said application No. 11/059,891 is a continuation-in-part of application No. 10/924,104, filed on Aug. 23, 2004, now abandoned, and a continuation-in-part of application No. 10/938,355, filed on Sep. 10, 2004, now abandoned, said application No. 11/060,179 is a continuation-in-part of application No. 10/924,104, and a continuation-in-part of application No. 10/938,355, said application No. 10/924,104 is a continuation-in-part of application No. 10/456,777, filed on Jun. 6, 2003, now Pat. No. 6,910,423, which is a continuation-in-part of application No. 09/938,022, filed on Aug. 23, 2001, now Pat. No. 6,598,534, said application No. 10/938,355 is a continuation-in-part of application No. 10/456,777, which is a continuation-in-part of application No. 09/938,022.

(51) Int. Cl.
*F42B 12/32* (2006.01)

(52) U.S. Cl. ..... 102/497; 102/475

(58) Field of Classification Search ..... 102/497, 102/475

See application file for complete search history.

(56) References Cited

U.S. PATENT DOCUMENTS

| | | | |
|---|---|---|---|
| 1,198,035 | A | 9/1916 | Huntington |
| 1,229,421 | A | 6/1917 | Downs |
| 1,235,076 | A | 7/1917 | Stanton |
| 1,244,046 | A | 10/1917 | Ffrench |

(Continued)

FOREIGN PATENT DOCUMENTS

DE 3327043 A1 2/1985

(Continued)

OTHER PUBLICATIONS

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.

(Continued)

*Primary Examiner* — Troy Chambers
(74) *Attorney, Agent, or Firm* — Iandiorio Teska & Coleman

(57) ABSTRACT

An aimable kinetic energy rod warhead system includes a plurality of rods and explosive segments disposed about the plurality of rods. There is at least one detonator for each explosive segment. A target locator system is configured to locate a target relative to the explosive segments. A controller is responsive to the target locator system and is configured to selectively detonate specified explosive segments at different times dependent on the desired deployment direction of the rods to improve the aiming resolution of the warhead.

11 Claims, 6 Drawing Sheets

U.S. PATENT DOCUMENTS 1,300,333 A 4/1919 Berry
1,305,967 A 6/1919 Hawks
2,296,980 A 9/1942 Carmichael
2,308,683 A 1/1943 Forbes
2,322,624 A 6/1943 Forbes
2,337,765 A 12/1943 Nahirney
2,925,965 A * 2/1960 Pierce ..... 89/135
2,988,994 A 6/1961 Fleischer, Jr. et al.
3,153,367 A * 10/1964 Ross et al. ..... 89/1.1
3,332,348 A 7/1967 Myers et al.
3,464,356 A 9/1969 Wasserman et al.
3,565,009 A * 2/1971 Allred et al. ..... 102/475
3,598,051 A 8/1971 Avery
3,656,433 A 4/1972 Thrailkill et al.
3,665,009 A 5/1972 Dickinson, Jr.
3,703,865 A * 11/1972 Gilbertson et al. ..... 102/475
3,757,694 A 9/1973 Talley et al.
3,771,455 A 11/1973 Haas
3,796,158 A * 3/1974 Conger ..... 102/492
3,796,159 A * 3/1974 Conger ..... 102/492
3,797,359 A 3/1974 Mawhinney et al.
3,818,833 A 6/1974 Throner, Jr.
3,846,878 A 11/1974 Monson et al.
3,851,590 A 12/1974 LaCosta
3,861,314 A 1/1975 Barr
3,877,376 A 4/1975 Kupelian
3,902,424 A 9/1975 Dietsch et al.
3,903,804 A 9/1975 Luttrell et al.
3,915,092 A 10/1975 Monson et al.
3,941,059 A 3/1976 Cobb
3,949,674 A 4/1976 Talley
3,954,060 A 5/1976 Haag et al.
3,960,085 A * 6/1976 Abernathy et al. ..... 102/492
3,977,330 A 8/1976 Held
4,015,527 A 4/1977 Evans
4,026,213 A * 5/1977 Kempton ..... 102/475
4,036,140 A 7/1977 Korr et al.
4,089,267 A 5/1978 Mescall et al.
4,106,410 A 8/1978 Borcher et al.
4,106,411 A 8/1978 Borcher et al.
4,147,108 A 4/1979 Gore et al.
4,172,407 A 10/1979 Wentink
4,210,082 A 7/1980 Brothers
4,211,169 A 7/1980 Brothers
4,216,720 A 8/1980 Kempton
4,231,293 A 11/1980 Dahn et al.
4,289,073 A 9/1981 Romer et al.
4,353,305 A 10/1982 Moreau et al.
4,376,901 A 3/1983 Pettibone et al.
4,430,941 A 2/1984 Raech, Jr. et al.
4,455,943 A 6/1984 Pinson
4,516,501 A 5/1985 Held et al.
4,538,519 A 9/1985 Witt et al.
4,638,737 A 1/1987 McIngvale
4,655,139 A 4/1987 Wilhelm
4,658,727 A * 4/1987 Wilhelm et al. ..... 102/494
4,662,281 A * 5/1987 Wilhelm et al. ..... 102/494
4,676,167 A 6/1987 Huber, Jr. et al.
4,729,321 A 3/1988 Stafford
4,745,864 A 5/1988 Craddock
4,770,101 A 9/1988 Robertson et al.
4,777,882 A 10/1988 Dieval
4,848,239 A * 7/1989 Wilhelm ..... 102/492
4,872,409 A 10/1989 Becker et al.
4,922,826 A 5/1990 Busch et al.
4,957,046 A 9/1990 Puttock
4,995,573 A 2/1991 Wallow
4,996,923 A 3/1991 Theising
5,050,503 A * 9/1991 Menz et al. ..... 102/475
H1047 H 5/1992 Henderson et al.
H1048 H 5/1992 Wilson et al.
5,182,418 A * 1/1993 Talley ..... 102/475
5,223,667 A 6/1993 Anderson
5,229,542 A 7/1993 Bryan et al.
5,313,890 A 5/1994 Cuadros
5,359,935 A 11/1994 Willett
5,370,053 A 12/1994 Williams et al.
5,524,524 A 6/1996 Richards et al.
5,535,679 A 7/1996 Craddock
5,542,354 A 8/1996 Sigler
5,544,589 A * 8/1996 Held ..... 102/492
5,577,431 A 11/1996 Küsters
5,578,783 A 11/1996 Brandeis
5,583,311 A 12/1996 Rieger
5,622,335 A 4/1997 Trouillot et al.
D380,784 S 7/1997 Smith
5,670,735 A 9/1997 Ortmann et al.
5,691,502 A 11/1997 Craddock et al.
5,796,031 A 8/1998 Sigler
5,823,469 A 10/1998 Arkhangelsky et al.
5,929,370 A 7/1999 Brown et al.
5,936,191 A 8/1999 Bisping et al.
6,010,580 A 1/2000 Dandliker et al.
6,035,501 A 3/2000 Bisping et al.
6,044,765 A 4/2000 Regebro
6,186,070 B1 2/2001 Fong et al.
6,223,658 B1 5/2001 Rosa et al.
6,276,277 B1 8/2001 Schmacker
6,279,478 B1 8/2001 Ringer et al.
6,279,482 B1 8/2001 Smith et al.
6,598,534 B2 7/2003 Lloyd et al.
6,622,632 B1 9/2003 Spivak
6,666,145 B1 12/2003 Nardone et al.
2003/0019386 A1 * 1/2003 Lloyd et al. ..... 102/494
2003/0029347 A1 2/2003 Lloyd
2004/0011238 A1 1/2004 Ronn et al.
2004/0055498 A1 3/2004 Lloyd
2004/0055500 A1 3/2004 Lloyd
2004/0129162 A1 7/2004 Lloyd
2004/0200380 A1 10/2004 Lloyd
2005/0016372 A1 1/2005 Kilvert
2005/0109234 A1 5/2005 Lloyd
2005/0115450 A1 6/2005 Lloyd
2005/0126421 A1 6/2005 Lloyd
2005/0132923 A1 6/2005 Lloyd

FOREIGN PATENT DOCUMENTS

DE 3722420 1/1989
DE 3735426 5/1989
DE 3830527 A1 3/1990
DE 3834367 4/1990
DE 3934042 4/1991
DE 3934042 A1 4/1991
DE H08-005299 1/1996
DE 195 24 726 A1 2/1996
EP 270 401 A1 6/1988
EP 872705 10/1998
EP 902250 3/1999
FR 2678723 A1 1/1993
FR 2695467 3/1994
GB 550001 12/1942
GB 2236581 4/1991
JP 1-296100 11/1989
JP 7 027500 1/1995
WO WO 97/27447 7/1997
WO WO 9930966 6/1999

OTHER PUBLICATIONS

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.

FAS Military Analysis Network (http://www.fas.org/man/dod-101/sys/land/m546.htm): M546 APERS-T 105-mm, Jan. 21, 1999.

FAS Military Analysis Network (http://www.fas.org/man/dod-101/sys/land/bullets2.htm): Big Bullets for Beginners, Feb. 6, 2000.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.

Richard M. Lloyd, "Aligned Rod Lethality Enhanced Concept for Kill Vehicles", 10th AIAA/BMDD Technology Conf, Jul. 23-26, Williamsburg, Virginia, 2001, pp. 1-12.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 2, pp. 19-77.
U.S. Appl. No. 10/301,420, filed Nov. 21, 2002, Lloyd.
U.S. Appl. No. 10/685,242, filed Oct. 14, 2003, Lloyd.
U.S. Appl. No. 10/924,104, filed Aug. 23, 2004, Lloyd.
U.S. Appl. No. 10/960,842, filed Oct. 7, 2004, Lloyd.
U.S. Appl. No. 11/059,891, filed Feb. 17, 2005, Lloyd.
U.S. Appl. No. 11/060,179, filed Feb. 17, 2005, Lloyd.
U.S. Appl. No. 11/185,135, filed Jul. 20, 2005, Lloyd.
U.S. Appl. No. 11/185,521, filed Jul. 20, 2005, Lloyd.
Richard M. Lloyd. "Aligned Rod Lethality Enhancement Concept for Kill Vehicles," AIAA/BMDD Technology Conf., Jun. 5, Maastricht, Netherlands, 2001:pp. 1-12.

* cited by examiner

KINETIC ENERGY ROD WARHEAD WITH AIMING MECHANISM

RELATED APPLICATIONS

This application is a Continuation-in-Part of prior U.S. patent application Ser. No. 11/059,891 filed Feb. 17, 2005 now U.S. Pat. No. 7,621,222 and this application is a Continuation-in-Part of prior U.S. patent application Ser. No. 11/060,179 filed Feb. 17, 2005 now U.S. Pat. No. 7,624,682, and the latter applications are each a Continuation-in-Part application of prior U.S. patent application Ser. No. 10/924,104 filed Aug. 23, 2004 now abandoned and a Continuation-in-Part application of prior U.S. patent application Ser. No. 10/938,355 filed Sep. 10, 2004 now abandoned, and each of these latter two applications are a Continuation-in-Part of prior U.S. patent application Ser. No. 10/456,777, filed Jun. 6, 2003 now U.S. Pat. No. 6,910,423 which is a Continuation-in-Part of prior U.S. patent application Ser. No. 09/938,022 filed Aug. 23, 2001, issued on Jul. 29, 2003 as U.S. Pat. No. 6,598,534B2. All of these patent applications and patents are incorporated herein by reference.

FIELD OF THE INVENTION

This subject invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, Trident or MX missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some "hit-to-kill" threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other. target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbooks by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, and "Physics of Direct Hit and Near Miss Warhead Technology", Volume 194, ISBN 1-56347-473-5, incorporated herein by this reference, provide additional details concerning "hit-to-kill" vehicles and blast fragmentation type warheads. Chapter 5 and Chapter 3 of these textbooks propose a kinetic energy rod warhead.

The two primary advantages of a kinetic energy rod warhead is that 1) it does not rely on precise navigation as is the case with "hit-to-kill" vehicles and 2) it provides better penetration than blast fragmentation type warheads.

The primary components associated with a theoretical kinetic energy rod warhead are a projectile core or bay including a number of individual lengthy rod projectiles or penetrators, and an explosive charge. When the explosive charge is detonated, the rod projectiles or penetrators are deployed. Typically, these components are within a hull or housing.

Greater lethality is achieved when all of the rods are deployed to interrupt the target. In order to aim the projectiles in a specific direction, the explosive charge can be divided into a number of explosive charge segments or sections, with sympathetic shields between these segments. Each explosive segment may have its own detonator. Selected explosive charge segments are detonated to aim the projectiles in a specific direction and to control the spread pattern of the projectiles. For instance, detonators on one side of the projectile core can be detonated to cause their associated explosive charge segments to eject specified hull sections, creating an opening in the hull on the target side. Other detonators on the opposite side of the core are detonated to deploy the projectile rods in the direction of the opening and thus towards the target. See e.g. U.S. Pat. No. 6,598,534 and U.S. Pat. Publ. No. 20040055500A1 which are incorporated herein by reference.

While a kinetic energy warhead including the foregoing design may be highly effective, the exact position of the target in relation to the warhead explosive charge segments may affect aiming accuracy. The target may be positioned relative to the warhead such that the center of the rod set does not travel close to the target direction, resulting in aiming errors. For example, the target may be in a position where deploying one set of explosive segments, i.e. three adjacent segments, will result in the center of the rod core travelling in a direction which is not the target direction, but where deploying a different set of explosive segments, i.e. four adjacent segments, still may not direct the rods towards the target as desired. Additionally, the number of explosive segments detonated will affect the total spray pattern diameter, which may be critical in some applications.

SUMMARY OF THE INVENTION

It is therefore an object of this invention to provide an improved kinetic energy rod warhead.

It is a further object of this invention to provide a higher lethality kinetic energy rod warhead.

It is a further object of this invention to provide a kinetic energy rod warhead which has a better chance of destroying a target.

It is a further object of this invention to provide a kinetic energy rod warhead with improved aiming accuracy.

The subject invention results from the realization that a kinetic energy rod warhead with enhanced aiming resolution can be achieved with explosive charge segments deployed in timed combinations to drive the rods in a specific deployment direction to more accurately strike a target.

The present invention thus provides a unique way to destroy a target, and may be used exclusively, or in conjunction with any of the warhead configurations and/or features for destroying targets disclosed in the applicant's other patents or patent applications such as those enumerated above. Additionally, the kinetic energy rod warhead of the present invention may further include features for kinetic energy rod warheads disclosed in U.S. patent application Ser. Nos. 11/059,891 and 11/060,179, to which this application claims priority and which are incorporated herein by reference, and/or other features as desired for a particular application.

The subject invention, however, in other embodiments, need not achieve all these objectives and the claims hereof should not be limited to structures or methods capable of achieving these objectives.

This invention features an aimable kinetic energy rod warhead system including a plurality of rods, explosive segments disposed about the plurality of rods, and at least one detonator for each explosive segment. A target locator system is configured to locate a target relative to the explosive segments and a controller is responsive to the target locator system. The controller is configured to selectively detonate specified explosive segments at different times dependent on the desired deployment direction of the rods to improve aiming resolution of the warhead. The selective detonation of specified explosive segments generates deployment vectors. The sum of the deployment vectors is a resolved deployment vector in the desired deployment direction. The warhead system may include eight explosive segments and there may be one detonator for each explosive segment. The warhead system may include sympathetic shields between each explosive segment, and the shields may be made of a composite material, which may be steel sandwiched between polycarbonate resin sheet layers. The rods may be lengthy metallic members and may be made of tungsten, and the rods may have a cylindrical cross-section. The explosive segments may be wedge-shaped and the explosive segments may surround the plurality of rods.

The desired deployment direction may be aligned with the center of a first explosive segment. The controller may be configured to detonate an explosive segment opposite the first explosive segment. The controller may be configured to simultaneously detonate an explosive segment opposite the first explosive segment and two explosive segments adjacent the explosive segment opposite the first explosive segment.

The desired deployment direction may be aligned with a first sympathetic shield. The controller may be configured to simultaneously detonate two explosive segments adjacent a sympathetic shield opposite the first sympathetic shield. The controller may be configured to simultaneously detonate four adjacent explosive segments including two explosive segments adjacent a sympathetic shield opposite the first sympathetic shield.

The desired deployment direction may be aligned between a first sympathetic shield and the center of a first explosive segment. The controller may be configured to simultaneously detonate an explosive segment opposite the first explosive segment and an explosive segment adjacent thereto which is closest to the desired deployment direction, and thereafter simultaneously detonate an explosive segment adjacent the explosive segment opposite the first explosive segment which is farthest from the desired deployment direction, and a next adjacent explosive segment. The controller may be configured to detonate an explosive segment closest to the desired deployment direction which is adjacent an explosive segment opposite the first explosive segment, then detonate the explosive segment opposite the first explosive segment, then detonate the explosive segment farthest from the desired deployment direction which is adjacent the explosive segment opposite the first explosive segment, and thereafter detonate a next adjacent explosive segment.

This invention also features a method of improving the aiming resolution of a kinetic energy rod warhead, the method including disposing explosive segments about a plurality of rods, locating a target relative to the explosive segments, and selectively detonating specified explosive segments at different times dependent on the desired deployment direction of the rods to improve aiming resolution. The method may further include disposing one detonator in each explosive segment. There may be eight explosive segments, and the method may further include disposing a sympathetic shield between the explosive segments. The shields may be made of a composite material which may be steel sandwiched between polycarbonate resin sheet layers. The rods may be lengthy metallic members and may be made of tungsten. The rods may have a cylindrical cross-section. The explosive segments may be wedge-shaped.

The method may include detonating an explosive segment opposite a first explosive segment when the desired deployment direction is aligned with the center of the first explosive segment, and the method may include simultaneously detonating an explosive segment opposite a first explosive segment and two explosive segments adjacent the explosive segment opposite the first explosive segment, when the desired deployment direction is aligned with the center of the first explosive segment. The method may include simultaneously detonating two explosive segments adjacent a sympathetic shield opposite a first sympathetic shield when the desired deployment direction is aligned with the first sympathetic shield.

The method may include simultaneously detonating four adjacent explosive segments including two explosive segments adjacent a sympathetic shield opposite a first sympathetic shield, when the desired deployment direction is aligned with the first sympathetic shield.

The method may include detonating an explosive segment closest to the desired deployment direction which is adjacent an explosive segment opposite a first explosive segment, then detonating the explosive segment opposite the first explosive segment, then detonating the explosive segment farthest from desired deployment direction which is adjacent the explosive segment opposite the first explosive segment, and thereafter detonating a next adjacent explosive segment, when the desired deployment direction is aligned between a first sympathetic shield and the center of the first explosive segment.

The method may include simultaneously detonating an explosive segment opposite a first explosive segment and an explosive segment adjacent thereto which is closest to the desired deployment direction, and thereafter simultaneously detonating an explosive segment adjacent the explosive segment opposite the first explosive segment which is farthest from the desired deployment direction and a next adjacent explosive segment, when the desired deployment direction is aligned between a first sympathetic shield and the center of the first explosive segment.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
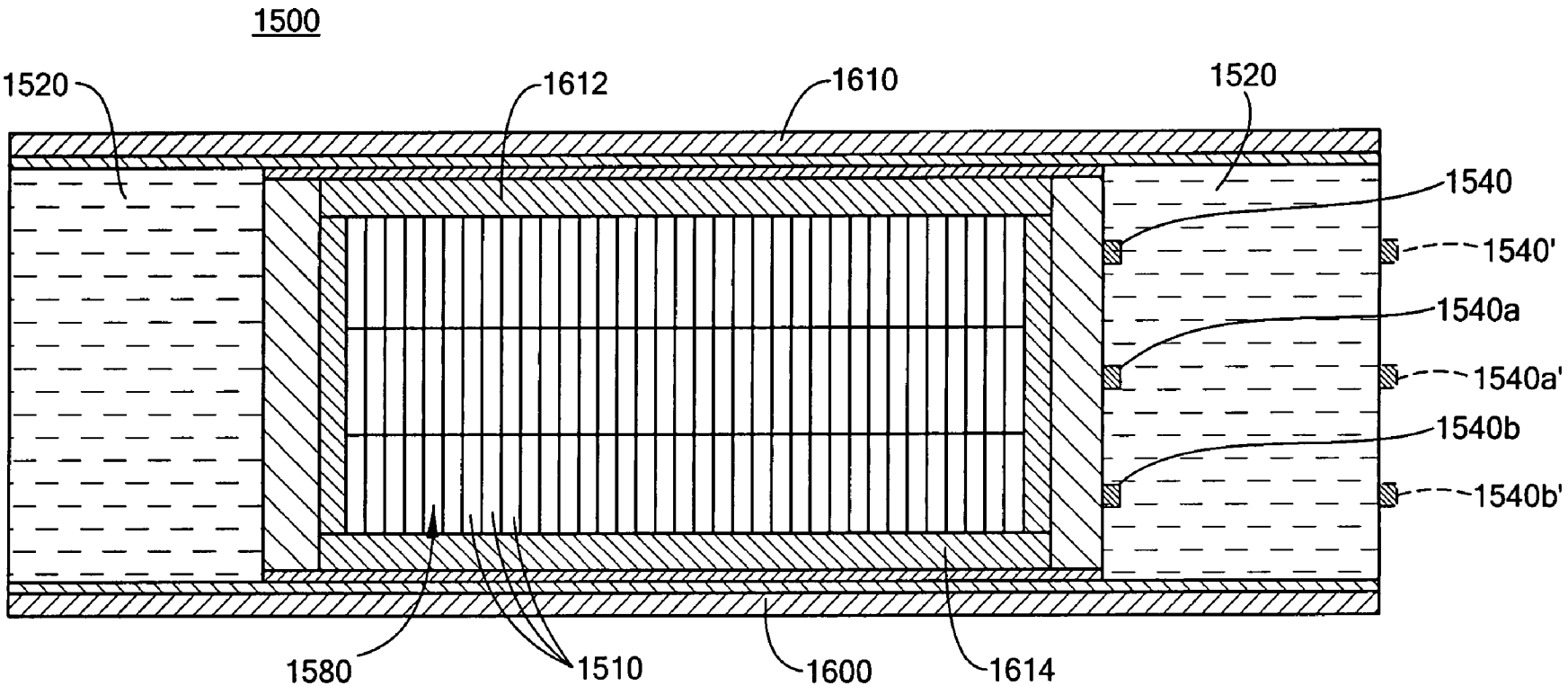
FIG. 1 is a schematic cross-sectional view of one example of a kinetic energy rod warhead in accordance with the present invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Current kinetic energy rod warhead designs allow a plurality of rods to be aimed, but the hardware can impose some constraints on the aiming accuracy. The present invention provides improved aiming resolution and better aiming accuracy despite such physical constraints.

The aimable kinetic energy rod warhead system and method of the present invention includes kinetic energy rod warhead 1500, FIG. 1, including plurality of rods or projectiles 1510, explosive 1520 for deploying rods 1510, and at least one detonator 1540 for detonating explosive 1520. Detonation of explosive 1520 deploys projectiles 1500. Notably, the shape and configuration of kinetic energy rod warhead 1500 is not limited to any particular configuration and may include but is not limited to features disclosed in prior U.S. patent application Ser. No. 11/059,891.

Although the exact configuration of the kinetic energy rod warhead may vary depending on a particular desired application or result to be achieved, in one embodiment kinetic rod warhead 1500 typically includes projectile core 1580, thin plates 1600, 1610 and thin aluminum absorbing layers 1612, 1614 about projectiles 1510.

Figure 2:
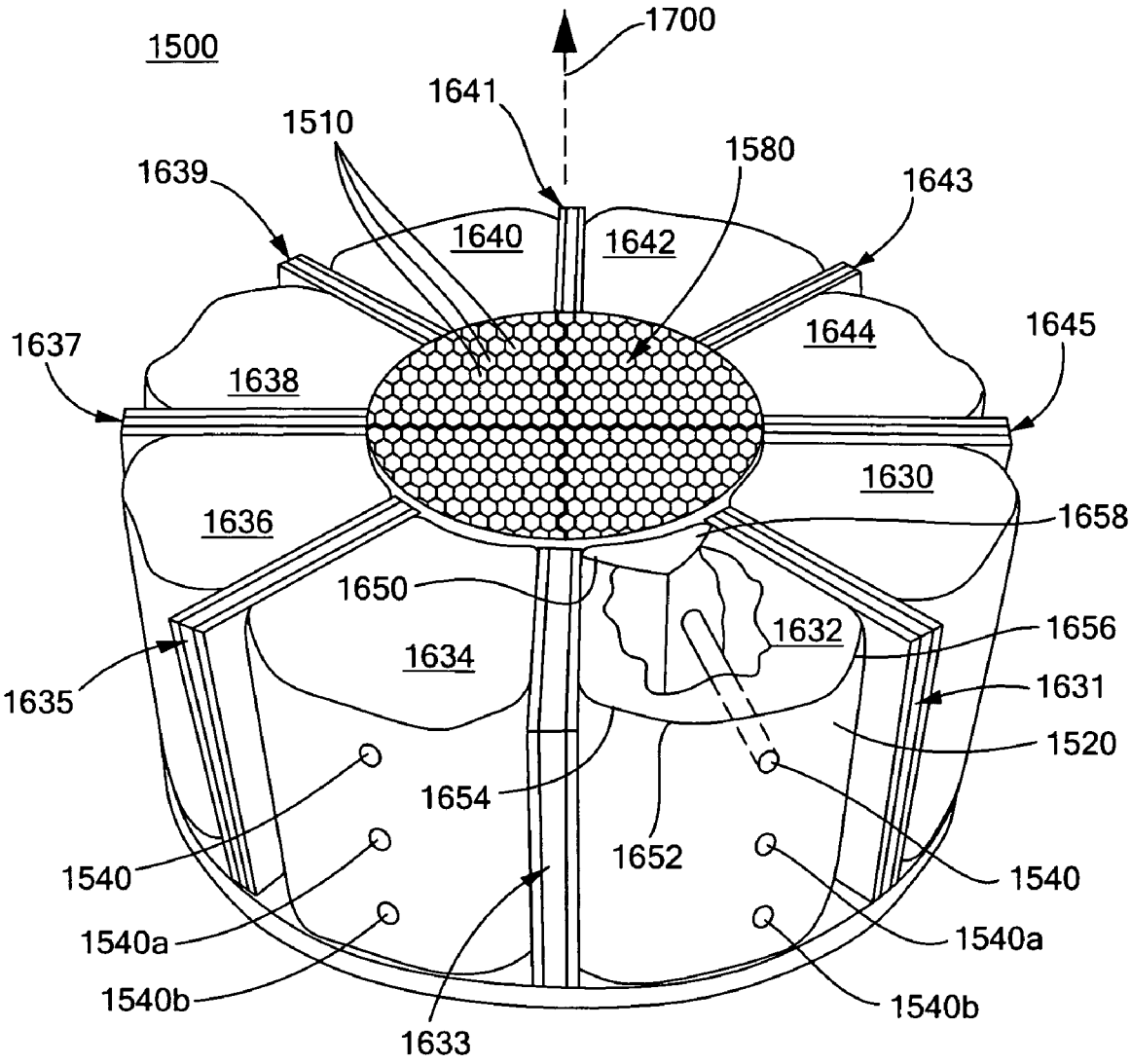
FIG. 2 is a schematic partial three-dimensional detailed view of the kinetic energy rod warhead of FIG. 1.

Preferably, explosive charge 1520, FIG. 2, is divided into segments 1630, 1632, 1634 and 1636 disposed about plurality of rods or projectiles 1510. In one example, sympathetic shields 1631, 1633, 1635 separate explosive segments 1630, 1632, 1634 and 1636, and projectile rods 1510 are lengthy metallic cylindrical members. In one embodiment, the rods are made of tungsten, and the sympathetic shields are made of composite material such as steel sandwiched between polycarbonate resin sheet layers, although the rods and sympathetic shields are not necessarily limited to these shapes or materials, and may be of various shapes or materials depending on a desired application. There is at least one detonator 1540 for each explosive segment (shown for segments 1632 and 1634) and there may be multiple detonators 1540*a*, 1540*b* which may be placed as shown or at 1540', 1540*a*', and 1540*b*', FIG. 1. Additional explosive segments 1638, 1640, 1642 and 1644, FIG. 2 are also disposed about projectile rods 1510 with their associated detonators (not shown) and are separated by sympathetic shields 1637, 1639, 1641, 1643 and 1645. In one variation, each explosive segment is wedge-shaped with proximal surface 1650 of explosive segment 1632 abutting projectile core 1580 and distal surface 1652 which is tapered as shown at 1654 and 1656 to reduce weight. The explosive segments may each include a wave shaper 1658 as shown in explosive segment 1632. In a manner similar to kinetic energy rod warheads generally, missile or other type of carrier 1660, FIG. 3 transports the kinetic energy rod warhead 1500 to the vicinity of a target.

Target locator system 1680 is configured to locate a target relative to explosive segments 1630, 1632, 1634, 1636, 1638, 1640, 1642, 1644, FIG. 2. Target locator systems are known in the art, and typically are part of a guidance subsystem such as guidance subsystem 1670, FIG. 3 which includes, for example, fusing technology and is also within carrier or missile 1660, also as known in the art.

In accordance with the present invention, however, controller 1690 is responsive to target locator system 1680 and is configured to selectively detonate specified explosive segments 1630, 1632, 1634, 1636, 1638, 1640, 1642, 1644, FIG. 2 at different times depending on the desired deployment direction of plurality of rods 1510 to improve the aiming resolution of kinetic energy rod warhead 1500. In the embodiments described herein, there are eight explosive segments in kinetic energy rod warhead 1500, but although this is a preferred embodiment, the invention is not limited to eight explosive segments. Also, with each of the examples and embodiments herein, and with the present invention generally, thin frangible hull 1800, FIG. 4 typically surrounds explosive segments 1630-1642.

Figure 3:
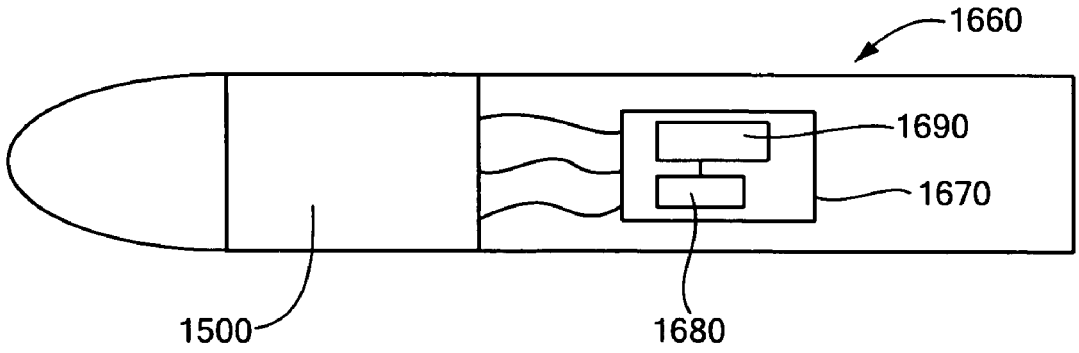
FIG. 3 is a schematic view of a controller and target locator system in accordance with the present invention.
Figure 4:
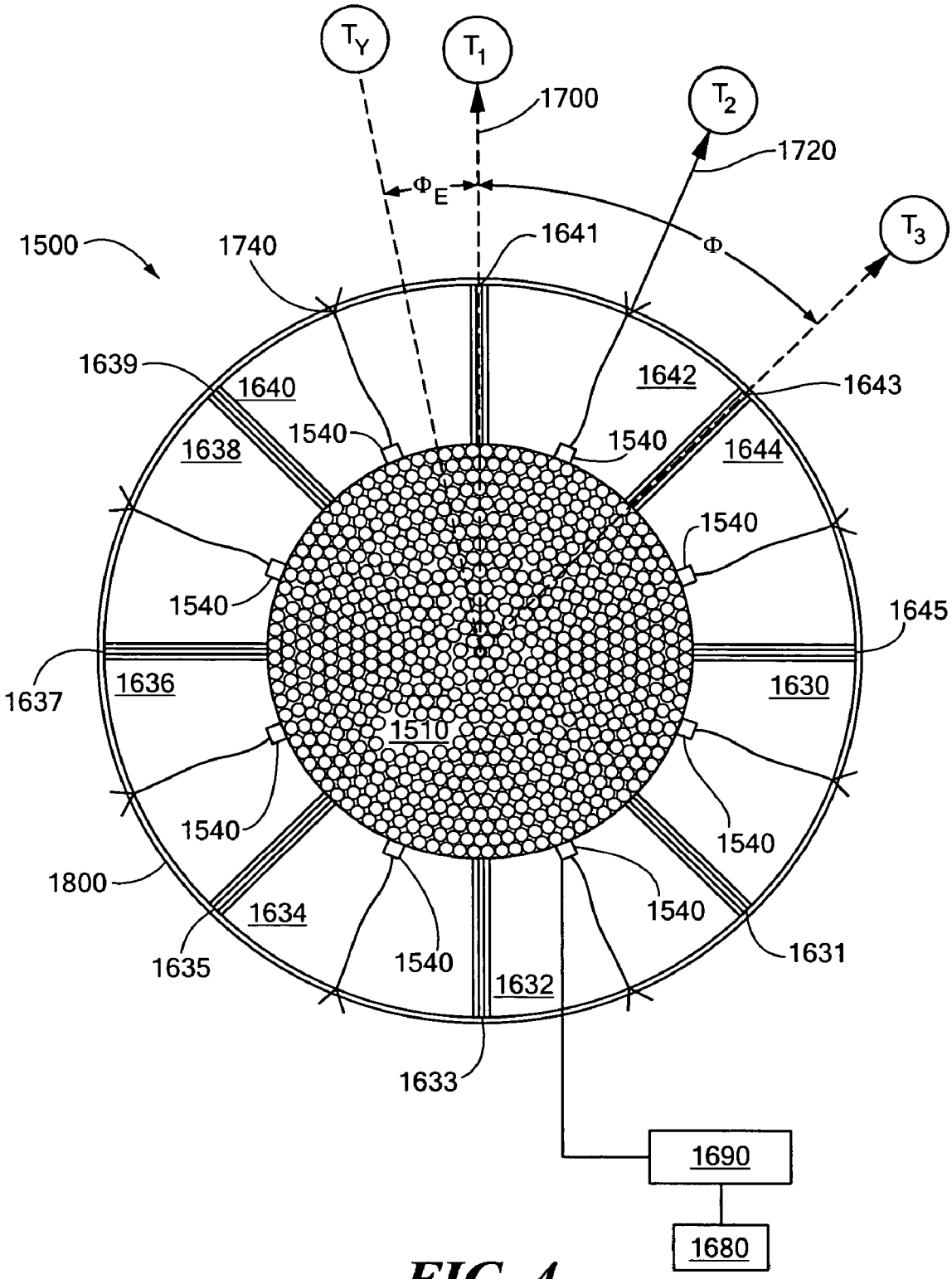
FIG. 4 is a cross-sectional schematic view of an eight segment kinetic energy rod warhead in accordance with the present invention.

For aiming purposes, any target location such as target locations $T_1$, $T_2$, $T_3$, and $T_Y$, FIG. 4 could be relative to a particular explosive segment. In FIG. 4, target locations $T_1$-$T_3$ are in positions relative to explosive segment 1642. The desired deployment direction of rods 1510 is the direction of the target, such as along vector 1700 for target $T_1$. For each example herein, target locator system 1680, FIG. 3 is configured to locate a target such as $T_1$, $T_2$, $T_3$, or other target, and controller 1690 is configured to selectively detonate selected or specified explosive segments at different times depending on the desired deployment direction. As discussed more fully below, for some target locations the physical constraints of the warhead hardware configuration cause no aiming difficulty. For certain target locations, however, the warhead hardware configuration introduces aiming errors, but these errors are decreased significantly by the present invention.

In one example, target locator system 1680 locates target at position $T_1$, FIG. 4 which is aligned with sympathetic shield 1641. Thus, the desired deployment direction 1700 of rods 1510 is aligned with sympathetic shield 1641. There are at least two ways to aim and deploy projectiles 1510 in a desired deployment direction along vector 1700 towards target $T_1$.

The first way is to simultaneously detonate explosive segments 1632 and 1634, which are adjacent sympathetic shield 1633 opposite sympathetic shield 1641. The primary firing direction of penetrators 1510 would be in the desired deployment direction 1700 toward target $T_1$, and thus rod projectiles 1510 would be deployed from kinetic energy rod warhead 1500 in the direction as shown.

A second way to deploy rod projectiles 1510 towards $T_1$ is to simultaneously deploy four adjacent explosive segments 1630, 1632, 1634 and 1636, which includes explosive segments 1632 and 1634 adjacent sympathetic shield 1633.

Thus, when target $T_1$ is aligned with a sympathetic shield, there is little if any aiming error even given the physical constraints of the kinetic energy rod warhead.

For a target such as target $T_2$ aligned proximate the center 1710 of explosive segment 1642, the desired deployment vector 1720 is aligned with the center 1710 of explosive segment 1642. In this case, there are also at least two ways to aim projectiles 1510 in desired deployment direction 1720. A first way is to detonate explosive segment 1634 which is opposite explosive segment 1642. A second way is to simultaneously detonate explosive segments 1634, and explosive segments 1632 and 1636 which are adjacent segment 1634. Detonating the explosive segments in either manner will result in little if any aiming errors, again despite the physical constraints of the kinetic energy rod warhead.

Figure 5:
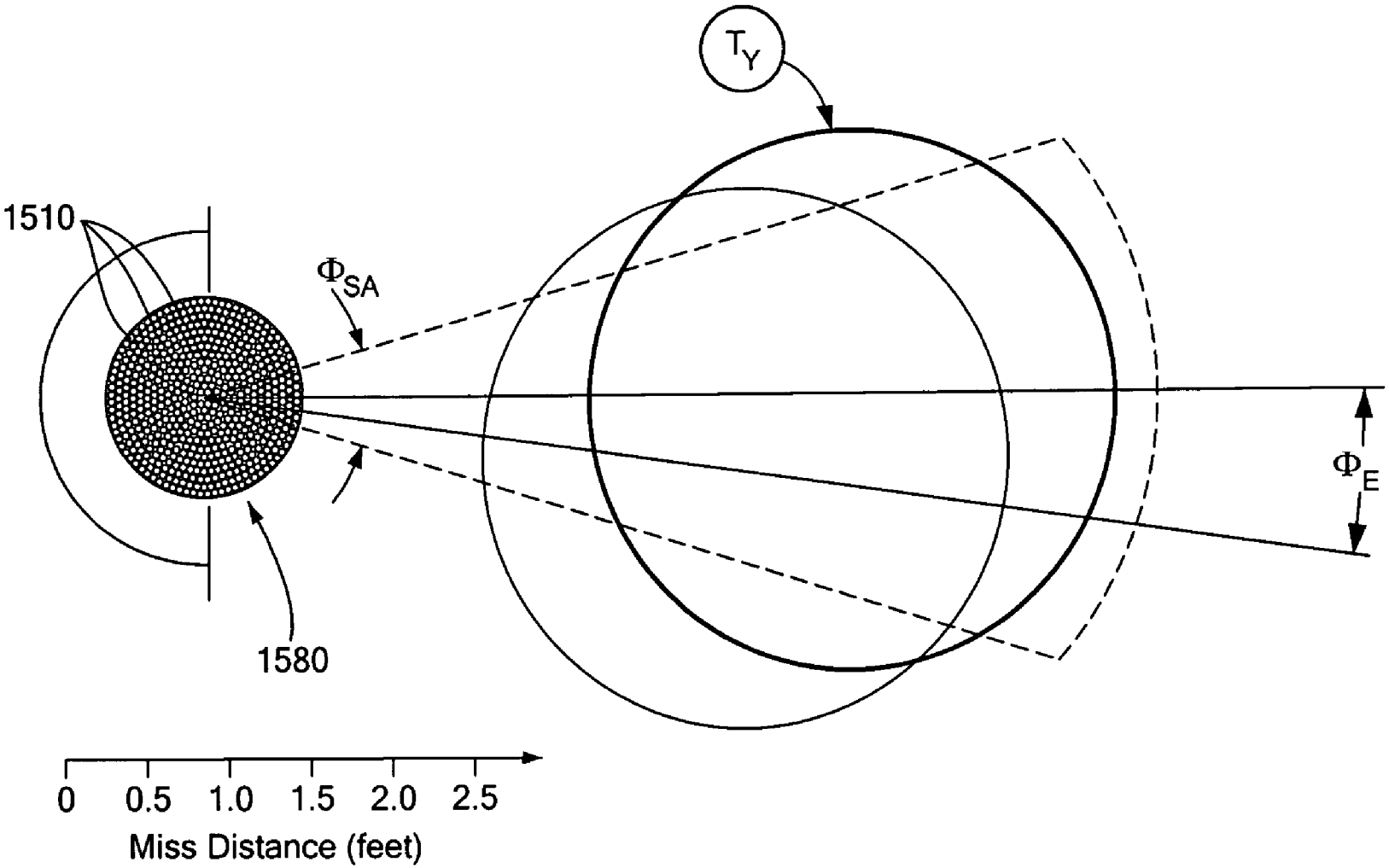
FIG. 5 is a schematic view of a particular kinetic energy rod warhead spray pattern.

For target $T_Y$ aligned between sympathetic shield 1641 and center 1710 of explosive segment 1640, however, the warhead hardware restricts the most accurate firing options to a) detonating one explosive segment, i.e. explosive segment 1632, or b) detonating three explosive segments, i.e. explosive segments 1630, 1632, and 1634 simultaneously. Either of these firing options could result in an aiming error of $\phi_E$, namely 11.125°. With such an error, for a spray angle of 35° at a miss distance of 5 feet, there would not be complete overlap of the plurality of rods 1510 with target $T_Y$ after detonation, as shown in FIG. 5A.

In accordance with the present invention, however, such aiming errors introduced by the warhead hardware configuration are greatly reduced by selectively detonating specified explosive segments at different times. The invention utilizes a time delay between deployment of explosive segments to bias the deployment vectors. For target $T_Y$, FIG. 6 located by target locator system 1680, the desired deployment direction 1730 of rods 1510 is aligned between sympathetic shield 1641 and center 1740 of explosive segment 1640. Controller 1690 is configured to selectively detonate specified explosive segments to decrease aiming errors significantly and improve aiming resolution. In one embodiment, controller 1690 is configured to first simultaneously detonate explosive segment 1632 which is opposite explosive segment 1640, and explosive segment 1630 which is adjacent explosive segment 1632 and closest to desired deployment direction 1730. Controller 1690 is further configured to thereafter simultaneously detonate explosive segment 1634 which is adjacent explosive segment 1632 and farthest from desired deployment direction 1730, and next adjacent explosive segment 1636. The time delay between the simultaneous detonation of segments 1630 and 1632 and the subsequent simultaneous detonation of segments 1634 and 1636 may be between 8.0 microseconds and 9.0 microseconds, preferably about 8.33 microseconds.

By detonating specified explosive segments at different times in accordance with the present invention, the rods can be aimed in any desired deployment direction. This high resolution aiming is caused by differential shock waves in the explosive segments and how their vectors combine. In this latter example, explosive segments 1630 and 1632 are detonated first, causing shock wave 1770 and generating a deployment vector $V_{12}$ which signifies the simultaneous detonation of the first two explosive segments 1630 and 1632. After the detonation of explosive segments 1630 and 1632, explosive segments 1634 and 1636 are detonated. The simultaneous detonation of explosive segments 1634 and 1636 causes another shock wave 1771 and generates deployment vector $V_{34}$. The sum of deployment vectors $V_{12}$ and $V_{34}$ is resolved vector $V_d$ which is the direction in which plurality of rods 1510 travel. More particularly, center 1775 of plurality of rods 1510 travels in direction $V_d$, which is the same direction as desired deployment direction 1730. Thus aiming resolution is greatly improved. The angle $\theta_Y$ is the difference between the direction of resolved vector $V_d$ and the direction of travel 1700 of plurality of rods 1510 if, for example, explosive segments 1630, 1632, 1634 and 1636 were all detonated simultaneously rather than at different times.

Figure 7:
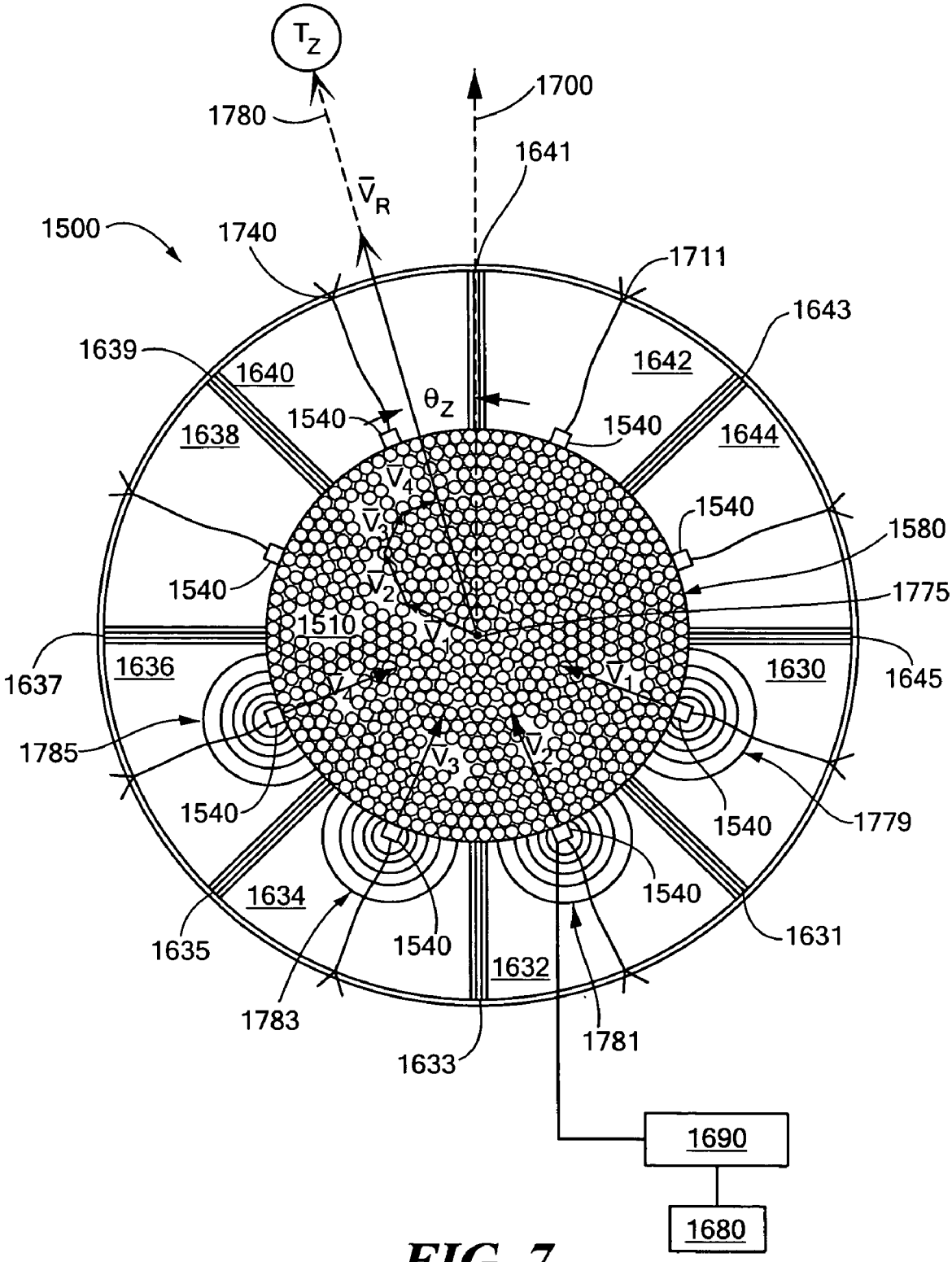

In another example shown in FIG. 7, target $T_Z$ located by target locator system 1680 is also aligned between sympathetic shield 1641 and center 1710 of explosive segment 1642. However, target $T_Z$ is aligned closer to sympathetic shield 1641 than target $T_Y$, FIG. 5 and the angle $\theta_Y$ is greater than angle $\theta_Z$, FIG. 7. Again the invention utilizes time difference to bias the deployment vectors and improve aiming resolution.

In this example, controller 1680 is configured to sequentially detonate explosive segments 1630, 1632, 1634 and 1636. Controller 1680 is configured to first detonate explosive segment 1630 closest to desired deployment direction 1780 and adjacent explosive segment 1632 which is opposite explosive segment 1640. Then explosive segment 1632 opposite segment 1640 is detonated. Explosive segment 1634 farthest from desired deployment direction 1780 and adjacent explosive segment 1632 is then detonated. The next adjacent explosive segment 1636 is detonated last. The time period between the detonations may be adjusted according to the exact location of a specific target. In one example, the time between the sequential detonation of each explosive segment 1630, 1632, 1634 and 1636 is approximately four (4) microseconds.

Figure 6:
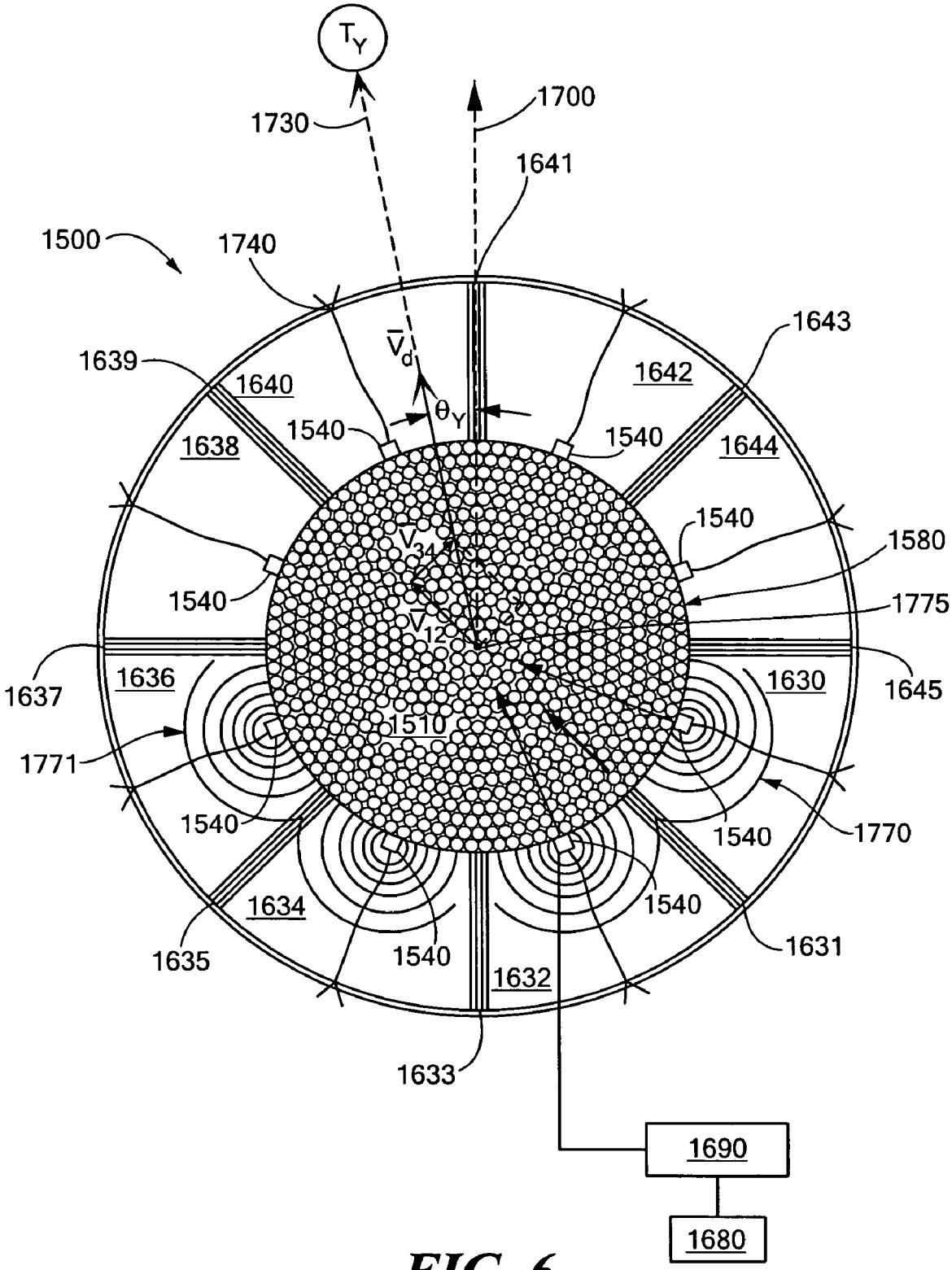
FIGS. 6-7 are cross-sectional schematic views of an eight segment kinetic energy rod warhead in accordance with the present invention.

In summary, explosive segment 1630 is detonated first, causing shock wave 1779 and generating deployment vector $V_1$. Then explosive segment 1632 is detonated, causing shock wave 1781 and generating deployment vector $V_2$. Thereafter explosive segment 1634 is detonated, causing shock wave 1783 and generating deployment vector $V_3$. Explosive segment 1636 is detonated last, causing shock wave 1785 and generating deployment vector $V_4$. The sum of deployment vectors $V_1$, $V_2$, $V_3$ and $V_4$ is resolved vector $V_R$ which is the direction plurality of rods 1510—specifically the center 1775 of plurality of rods 1510—travel. The direction of resolved vector $V_R$ is the same as desired deployment direction 1780. Again there is a great reduction in aiming error. The angle $\theta_Z$ is the difference between the direction of resolved vector $V_R$ and the direction of travel 1700 of plurality of rods 1510 if, for example, explosive segments 1630, 1632, 1634 and 1636 were detonated simultaneously rather than each at different times. Also, the difference between $\theta_Y$, FIG. 5 and $\theta_Z$, FIG. 6 is the difference between a) simultaneous detonation of segments 1630 and 1632 first followed by simultaneous detonation of segments 1634 and 1636, and b) the sequential detonation of segments 1630, 1632, 1634 and 1636.

In a similar manner, a target located between any sympathetic shield center and any of an explosive segment may be more accurately targeted. For example, if the target is at $T_A$, FIG. 7, between sympathetic shield 1641, FIG. 7, and center 1711 of explosive segment 1642, explosive segments 1634 and 1636 may be simultaneously detonated, followed by the simultaneous detonation of segments 1632 and 1630. Alternatively, explosive segments 1636 may be detonated first, followed by the detonation of explosive segment 1634, then 1632, then 1630 in order.

With the present invention the amount of time between detonation of any of the explosive segments is not limited, and may be adjusted according to the location of a particular target and desired deployment direction. By using various time differences the directions of the deployment vectors, and consequently the resolved deployment vector, can be adjusted to any desired deployment direction and/or any target location.

Thus, with specified explosive charge segments detonated in timed combination in accordance with the present invention, aiming resolution is improved and rod penetrators of the aimable kinetic energy rod warhead of the present invention are more accurately propelled in the direction of a target to increase overall kill probability and lethality.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. An aimable kinetic energy rod warhead system comprising:

a plurality of rods in a projectile core;

explosive segments surrounding the plurality of rods;

at least one detonator for each explosive segment;

sympathetic shields between the explosive segments;

a target locator system configured to locate a target aligned with a location between a sympathetic shield and the center of an explosive segment; and a controller, responsive to the target locator system, configured to sequentially selectively detonate specified individual explosive segments at different times to cause individual explosive segment shock waves which generate individual deployment vectors, the sum of which is a resolved deployment vector to deploy said plurality of rods from the projectile core at said target as aligned and thereby improve aiming resolution of the warhead.

2. The aimable kinetic energy rod warhead system of claim 1 in which there are eight explosive segments.

3. The aimable kinetic energy rod warhead system of claim 1 in which there is one detonator for each explosive segment.

4. The aimable kinetic energy rod warhead system of claim 1 in which the shields are made of a composite material.

5. The aimable kinetic energy rod warhead system of claim 4 in which the composite material is steel sandwiched between polycarbonate resin sheet layers.

6. The aimable kinetic energy rod warhead system of claim 1 in which the rods are lengthy metallic members.

7. The aimable kinetic energy rod warhead system of claim 6 in which the rods are made of tungsten.

8. The aimable kinetic energy rod warhead system of claim 1 in which the rods have a cylindrical cross-section.

9. The aimable kinetic energy rod warhead system of claim 1 in which the explosive segments are wedge-shaped.

10. The aimable kinetic energy rod warhead system of claim 1 in which the controller is configured to simultaneously detonate an explosive segment opposite said explosive segment and an explosive segment adjacent thereto which is closest to the desired deployment direction, and thereafter simultaneously detonate an explosive segment adjacent the explosive segment opposite said explosive segment which is farthest from the desired deployment direction and a next adjacent explosive segment.

11. The aimable kinetic energy rod warhead system of claim 1 in which the controller is configured to detonate an explosive segment closest to the desired deployment direction which is adjacent an explosive segment opposite said explosive segment, then detonate the explosive segment opposite said explosive segment, then detonate the explosive segment farthest from the desired deployment direction which is adjacent the explosive segment opposite said explosive segment, and thereafter detonate a next adjacent explosive segment.

* * * * *